US009564727B2

(12) United States Patent
Dierks et al.

(10) Patent No.: US 9,564,727 B2
(45) Date of Patent: Feb. 7, 2017

(54) CRIMPING APPARATUS FOR TURNED CONTACTS

(71) Applicant: Weidmueller Interface GmbH & Co. KG, Detmold (DE)

(72) Inventors: Christoph Dierks, Detmold (DE); Guenther Hanning, Detmold (DE); Detlev Hetland, Detmold (DE); David Keller, Lemgo (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 713 days.

(21) Appl. No.: 13/931,880

(22) Filed: Jun. 29, 2013

(65) Prior Publication Data

US 2014/0013594 A1 Jan. 16, 2014

(30) Foreign Application Priority Data

Jul. 11, 2012 (DE) ..... 20 2012 102 562 U

(51) Int. Cl.
*H01R 43/042* (2006.01)

(52) U.S. Cl.
CPC ..... *H01R 43/042* (2013.01); *H01R 43/0424* (2013.01); *Y10T 29/53226* (2015.01)

(58) Field of Classification Search
CPC ..... H01R 43/042; H01R 43/0424; Y10T 29/53226
USPC ..... 29/751, 750, 748, 747, 745, 729, 700; 72/20.1, 31.01, 409.01, 402, 31.12, 409.08, 72/409.11, 450; 81/90.2, 58, 90.1, 90.3, 90.5, 81/91.1, 126, 128, 313, 367, 427.5, 300, 303
See application file for complete search history.

(56) References Cited

U.S. PATENT DOCUMENTS 3,063,313 A 11/1962 Ustin
3,459,029 A * 8/1969 Rosenfeld ..... H01R 43/0424 72/31.12
6,176,116 B1 1/2001 Wilhelm et al.

FOREIGN PATENT DOCUMENTS

| | | | |
|---|---|---|---|
| CN | 101595608 | A | 12/2009 |
| DE | 10 2005 003 617 | B3 | 6/2006 |
| DE | 10 2007 005 176 | A1 | 8/2008 |
| DE | 102009026470 | A1 | 12/2010 |
| WO | 9000098 | A1 | 1/1990 |

* cited by examiner

*Primary Examiner* — Peter DungBa Vo
*Assistant Examiner* — Azm Parvez
(74) *Attorney, Agent, or Firm* — Lawrence E. Laubscher, Sr.; Lawrence E. Laubscher, Jr.; Robert D. Spendlove

(57) ABSTRACT

A crimping tool is provided for crimping the tubular portion of a turned electrical contact concentrically about the bare end of an electrical conductor, including a tool body having a main first portion, and an integral coplanar second portion extending from the main body portion to define a first lever. A crimping die arrangement includes an annular stamp holder mounted opposite an opening contained in the tool body main first portion, and an annular thrust collar is mounted concentrically about the stamp holder for angular displacement between released and crimping positions, thereby to displace a plurality of stamp members radially of the stamp holder between released an crimping positions The thrust collar is angularly displaced between the released and crimping positions by a toggle link arrangement that connects a second lever both with the tool body main portion and with the thrust collar.

15 Claims, 7 Drawing Sheets

137
104
106
106a
105
132
112
106c
138
149
107
125
106d
140
112
107
102
115
117
127
116
106b
118
126

CRIMPING APPARATUS FOR TURNED CONTACTS

REFERENCE TO RELATED APPLICATIONS

This application claims priority of, and is based on, the German Application No. DE 20 2012 102 562.0 filed Jul. 11, 2012.

BACKGROUND OF THE INVENTION

Field of the Invention

A crimping tool is provided for crimping the tubular portion of a turned electrical contact concentrically about the bare end of an electrical conductor, including a tool body having a main first portion, and an integral coplanar second portion extending from the main body portion to define a first lever. A crimping die arrangement includes an annular stamp holder mounted opposite an opening contained in the tool body main first portion, and an annular thrust collar is mounted concentrically about the stamp holder for angular displacement between released and crimping positions, thereby to displace a plurality of stamp members radially of the stamp holder between released an crimping positions The thrust collar is angularly displaced between the released and crimping positions by a toggle link arrangement that connects a second lever both with the tool body main portion and with the thrust collar. A cascade spring force-distance arrangement adjusts the angular position of the thrust collar relative to the die arrangement when the second lever is pivoted beyond the closed position toward a maximum exertion position, which cascade spring arrangement includes a deformable resilient spring defined in the tool body main portion, and a leaf spring carried by the first lever.

Description of Related Art

Crimping tools are known in the prior art for fastening turned electrical contacts upon the bare ends of insulated wires, as shown, for example, by the German patent No. DE 10 2009 026 470 A1. In this apparatus, the lack of a force-distance adjustment device must be compensated for by the manual unlocking of a locking latch in the handle part of the tool, whereupon the crimping die, during the crimping of a turned contact upon a conductor, was blocked. Moreover, the tool must be set for the cross-sectional size of a conductor prior to the crimping operation.

The operation of the crimping tool is rather laborious because of the absence of the force-distance adjustment device. Moreover, the diameter range of the turned contacts that can be pressed with the crimping tool is limited.

However, it is desirable to have a crimping tool for turned contacts that is provided with an automatically operating force-distance adjustment so that there will be no need for the manual unlocking or adjustment of the crimping tool and, moreover, it will permit the crimping of turned contacts upon conductors with the largest possible diameter range so that the largest possible spectrum of conductor cross-sections can be provided with turned contacts with the help of a single crimping tool.

The present invention was developed therefore to provide a crimping tool for turned contacts that will avoid the abovementioned disadvantages.

SUMMARY OF THE INVENTION

Accordingly, a primary object of the invention is to provide crimping tool for crimping the tubular portion of a turned electrical contact concentrically about the bare end of an electrical conductor, including a tool body having a main first portion, and an integral coplanar second portion extending from the main body portion to define a first lever. A crimping die arrangement includes an annular stamp holder mounted opposite an opening contained in the tool body main first portion, and an annular thrust collar is mounted concentrically about the stamp holder for angular displacement between released and crimping positions, thereby to displace a plurality of stamp members radially of the stamp holder between released an crimping positions The thrust collar is angularly displaced between the released and crimping positions by a toggle link arrangement that connects a second lever both with the tool body main portion and with the thrust collar. A cascade spring force-distance arrangement adjusts the angular position of the thrust collar relative to the die arrangement when the second lever is pivoted beyond the closed position toward a maximum exertion position, which cascade spring arrangement includes a deformable resilient spring defined in the tool body main portion, and a leaf spring carried by the first lever.

According to another object, the levers are normally biased by a return spring toward the open position, and when the levers are in the closed position, a stop arrangement prevents premature opening of the crimping die.

A further object is to provide a crimping tool for turned contacts, where there is provided a force-distance adjustment arrangement in the form of a cascade spring, one of whose parts is a part of the basic tool body sheet metal pieces, and whose other part is a lever. The invention is thus based on the concept that by virtue of the advantageous spring action due to the cooperation of the springs, it is possible to supply an increased force and an increased distance for the force-distance adjustment of the crimping tool. In this way, the crimping tool can be used to crimp turned contacts on conductors with the largest possible diameter range.

A first part of the cascade spring arrangement is formed in the basic sheet metal pieces of the tool body, and is preferably defined by in each case by a slot contained in the basic sheet metal piece and that extends essentially parallel to the outer contour of the basic sheet metal piece. The terminal point of this slot is rounded to reduce the mechanical tension at the terminal point of the slot. Along its contour line, the slot advantageously runs around the associated pivot pin, and adjacent the top of the handle, emerges out of the basic sheet metal piece. This first spring preferably has a geometric configuration in the form of an arc-shaped or circular-arc segment-shaped leaf spring. To provide a worthwhile spring travel, the slot is preferably done correspondingly long and wide. The spring, thus made, is therefore outside the associated handle. By arranging the slots in opposed relation in both sheet metal pieces, a parallel alignment of both springs is obtained.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

By the term "turned contact" is meant those electrical contacts that are mounted on flexible conductors, whose flexibility rests on the combination of a plurality of thin conductor wires, which are combined into one conductor by means of the casing of the conductor. When such conductors, for example, are integrated into plugs, then corresponding contacts are usually employed which, on the one hand, consist of a sleeve that in the non-crimped state will receive the insulated conductor and, on the other hand, will form a massive contact, which, for example, can be integrated into a plug with multiple contacts. Such contacts, for example, are made as automatic turning part so that the concept of "turned contact" obviously provides information concerning a possible production technology used for such a contact so that such contacts are generally known to the expert by this term.

Figure 1:
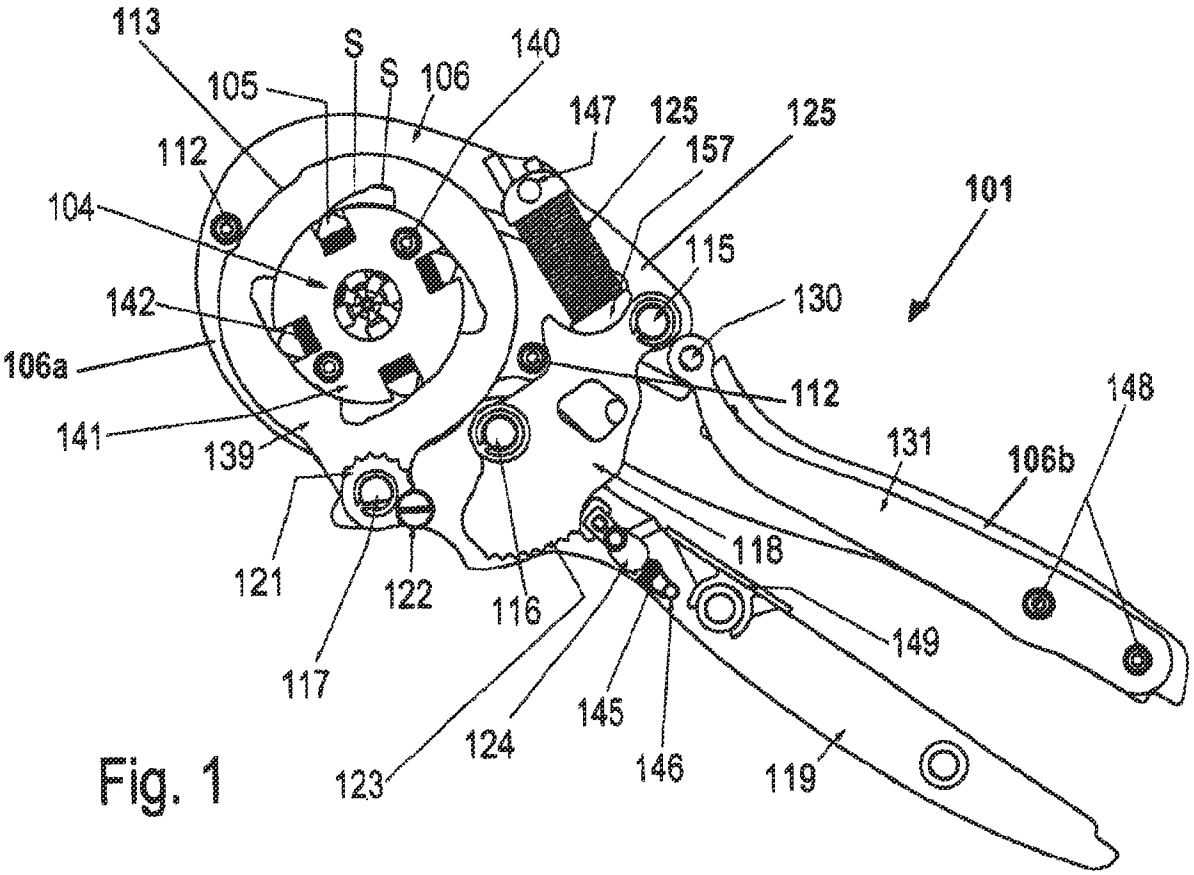
FIG. 1 is a left side elevation view of the crimping tool of the present invention, with certain parts removed.
Figures 2, 3:
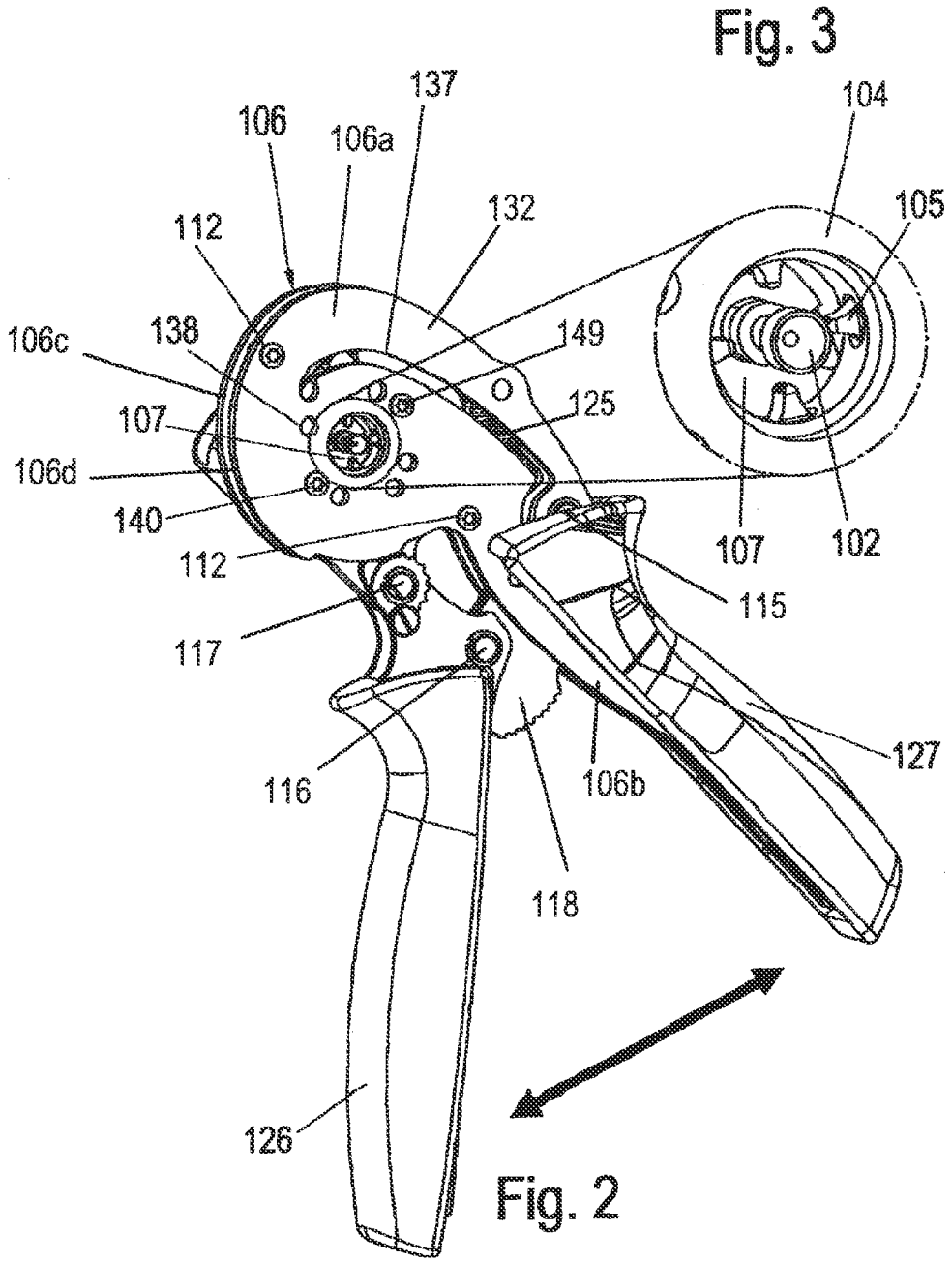
FIG. 2 is a left perspective view of the crimping tool of FIG. 1.
FIG. 3 is a detailed perspective view of the die arrangement of FIG. 2.
Figure 9:
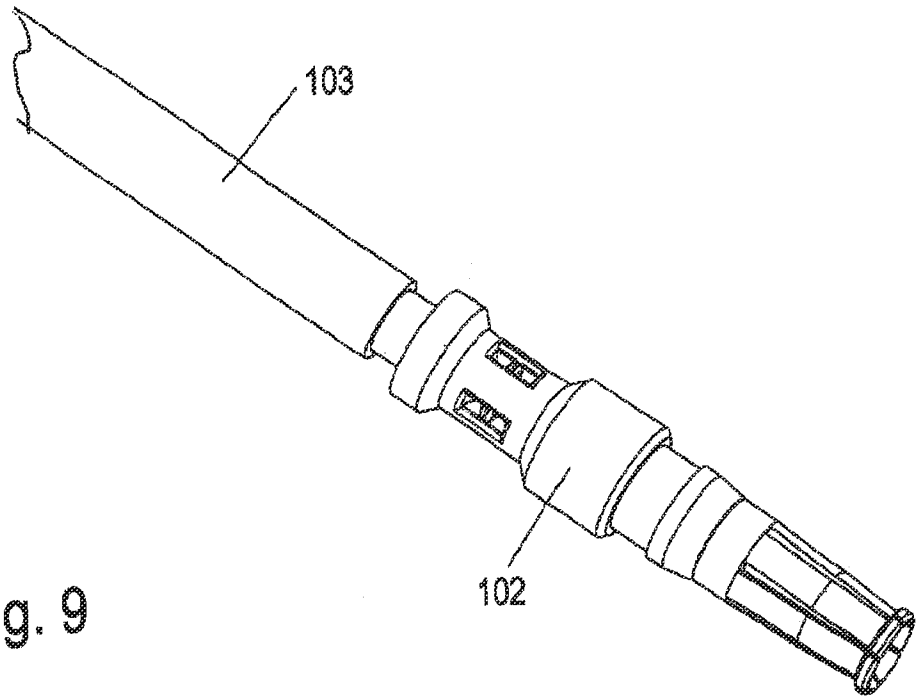
FIG. 9 is a perspective view illustrating the turned contact crimped upon the bare end of an insulated conductor.

Referring first more particularly to FIGS. 1 and 2, the crimping tool 101 of the present invention serves for the crimping of turned contacts 102 upon the bare ends of insulated conductors 103 (FIG. 9). The manually operated crimping tool 101 is in the form of tongs or pliers and includes a crimping die arrangement 104 having automatic adjustment to the sizes of the crimping sleeves and conductor cross-sections that are to be processed, which die arrangement includes a plurality of crimping stamps 105. The crimped turned contact 102 can be made in the form of a free- or n-point crimp.

As shown in FIG. 2, the crimping tool 101 includes a tool body 106 having a main first portion 106*a*, and a second portion that extends from the main portion to define a first lever 106*b*. The tool body is formed from two parallel spaced sheet metal plates 106*c* and 106*d* that are bolted together by bolts 112. Fastened between the plates 106*c* and 106*d* by bolts 140 opposite opposed openings 107 (FIG. 3) contained in the plates is a stationary annular stamp holder 141 that contains a plurality of radial through bores in which are slidably mounted a plurality of radially displaceable crimping stamps 105, respectively. Mounted in angularly adjustable relation concentrically about the stamp holder 141—and between the tool body plates 106*c* and 106*d*—is an annular thrust collar 139. This thrust collar has an internal surface provided with a plurality of cam surfaces S arranged for cooperation with corresponding crimping stamps 105, respectively. Compression springs 142 (FIG. 5) bias the crimping stamp members 105 radially outwardly toward engagement with the cam surfaces S on the inner circumference of the thrust collar 139. The angular adjustment between the thrust collar 139 and the crimping stamp holder 141 is limited by the extent of cooperation between stationary bolt 112 and the groove 113 provided in the outer circumferential surface of the thrust collar 139, thereby defining the minimum and maximum openings of the crimping die arrangements 104.

Figures 4, 5:
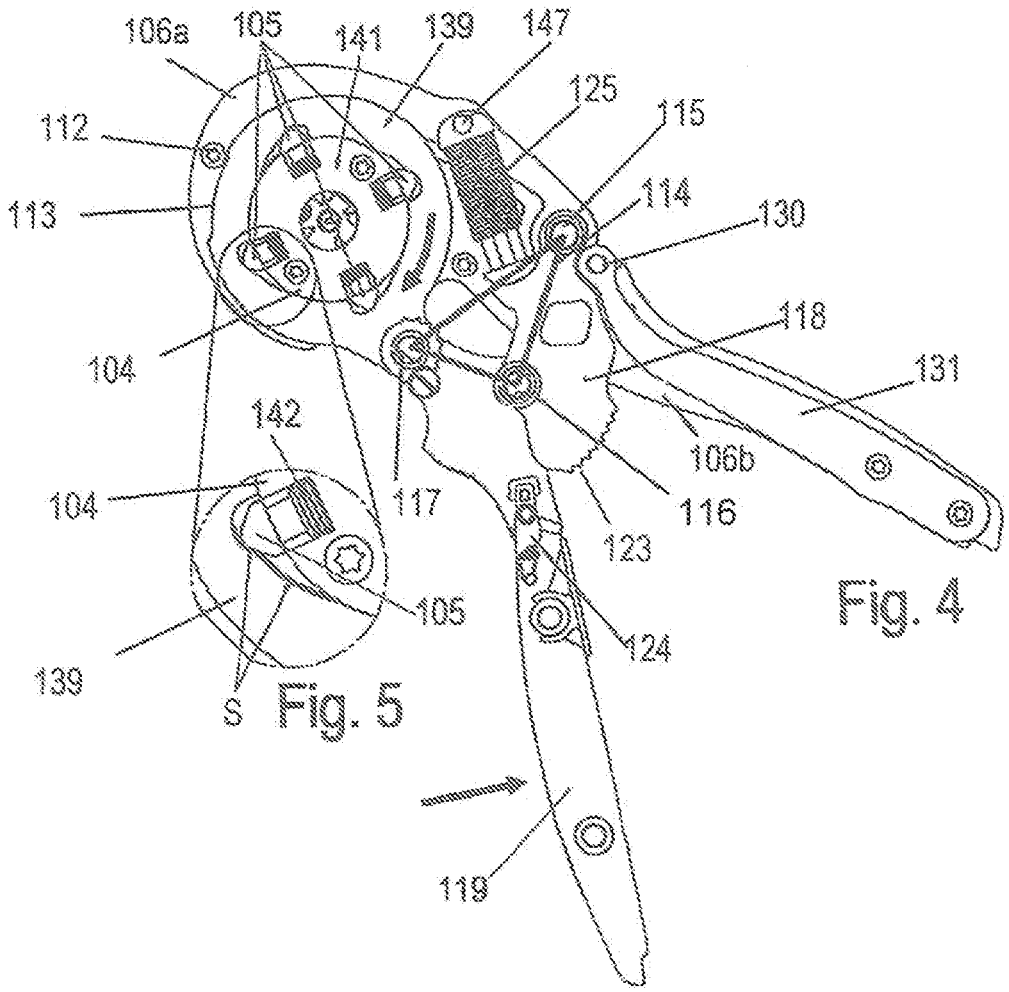
FIG. 4 is a left hand elevation view of the apparatus of FIG. 3 with certain parts removed.
FIG. 5 is a detailed view of the stamp member arrangement of FIG. 4.
Figure 6:
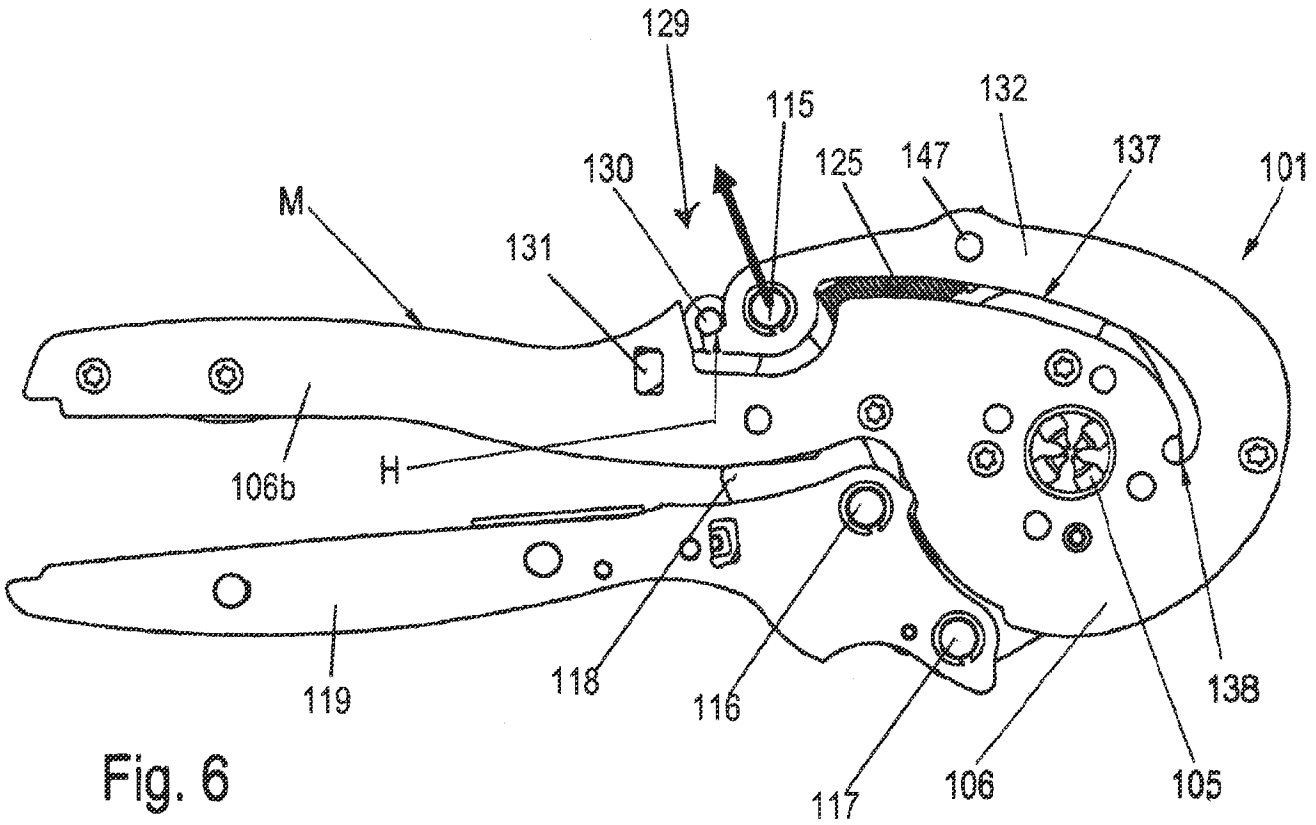
FIG. 6 is a right side elevation of the crimping tool of FIG. 1 when the handles are in the closed condition.
Figure 7:
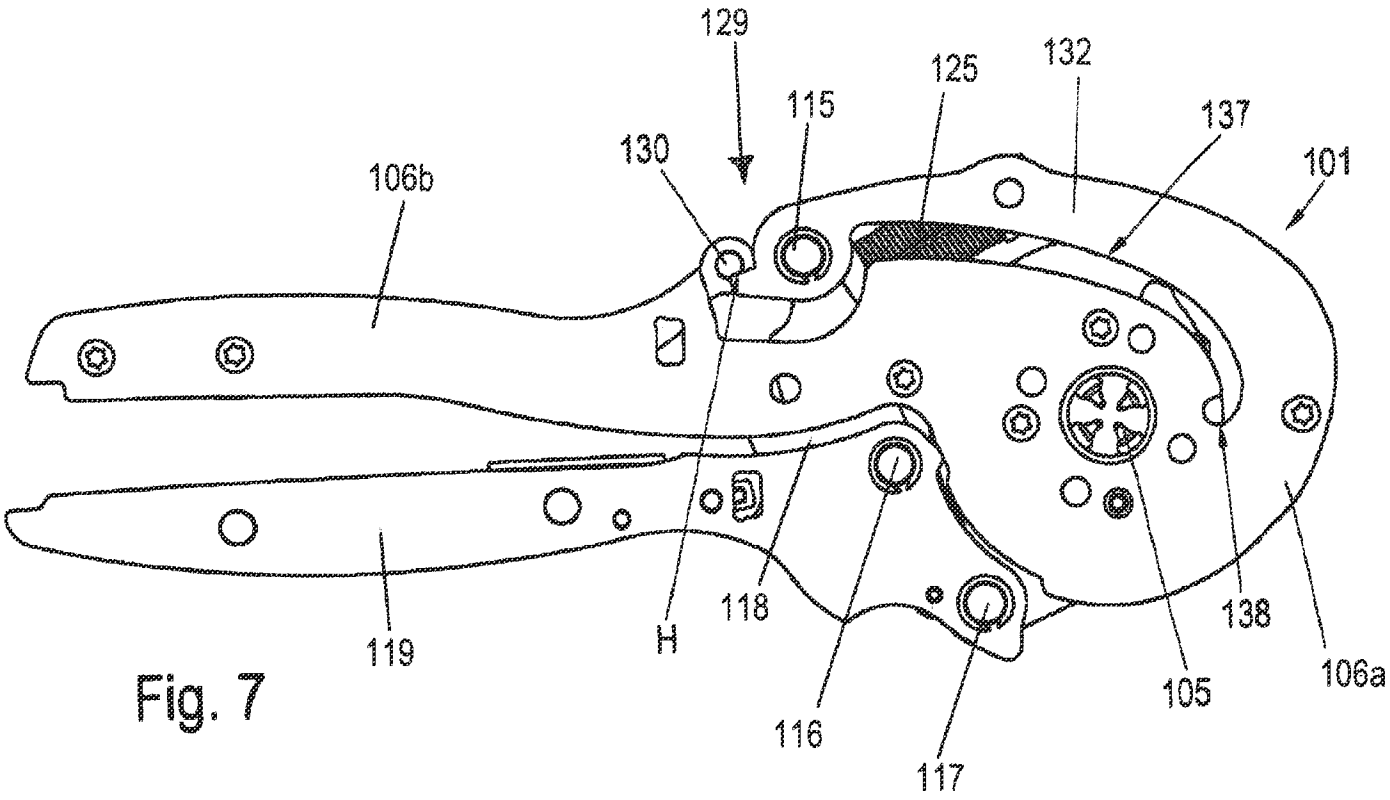
FIG. 7 is a corresponding view of the crimping tool when the handles are pivoted further together beyond the closed position toward the maximum exertion position.

According to a characterizing feature of the invention best shown in FIGS. 2, 6 and 7, the tool body plates 106*c* and 106*d* of the main first body portion 106*a* contain opposed slots 137 that define in the main first body portion 106*a* a resilient deformable leaf-type first spring 132. Each slot is forwardly directed and includes a rounded end 138 (FIGS. 6 and 7), thereby to reduce the mechanical tension at the terminal point of the slot. The free end of this first spring 132 is provided with a pivot pin 115 for connecting the first spring 132 with one end of thrust strut 118 (FIG. 1). The other end of this thrust strut 118 is pivotally connected by pivot pin 116 with an intermediate portion of a second metal lever 119. Eccentric pivot pin 117 pivotally connects one end of second lever 119 with a radial tab portion of thrust collar 139. As shown in FIG. 4, pivot pins 115 and 116, and eccentric pivot pin 117 define a toggle lever kinetic arrangement 114 for angularly displacing the thrust collar 139 in the clockwise direction shown by the arrow, thereby closing the crimping die arrangement 104. The levers 106*b* and 119 are biased from the closed position of FIG. 1 toward the open position of FIG. 4 by compression spring 125 that is pivotally connected at its upper end by pivot pin 147 with the free end of first spring 132, and reacts at its lower end 157 with an intermediate portion of the thrust strut 118.

The basic position of the crimping die assembly 104 can be changed by turning the eccentric bolt 117. In this way, one can adapt the degree of opening of the opened crimping die assembly 104 to the diameter of the turned contact 102 prior to the crimping so that an essential part of the working stroke of the crimping die assembly 104 must be carried out merely as an unproductive return stroke until crimping die assembly 104 comes into contact with the turned contact 102. The adjustment disc 121 and the flathead screw 122 fasten the eccentric pivot pin 117 in the adjusted position. Here, eccentric pivot pin 117 is used only for the initial basic calibration setting, and possibly to balance out any production or finishing tolerances. The user of the crimping tool customarily does not adjust the eccentric pivot pin 117

To make sure that the crimping die assembly 104 will always be reliably operated all the way to the final stop, the thrust strut 118 includes a gear arrangement 123 which engages the stop device 124 and thus prevents premature opening of the crimping die assembly 104. Return compression spring 125 provides for the automatic opening of crimping die assembly 104 after the crimping of the turned contact 102 has been completed.

FIG. 2 and FIG. 3 illustrate the manner in which a turned contact 102 is introduced into the opening defined by crimping die assembly 104. By manually bringing together the handles 126, 127 of the crimping tool 101, the turned contact 102 is crimped upon conductor 103. Essential in terms of the invention is the fact that the handle members 126, 127 mounted on the levers 119 and 106*b* respectively, will not display any local cross-section decrease or weakening, for example, in the form of a constriction that would result in an increased elasticity or an increased spring action.

FIGS. 4 and 5 show the drive mechanics of an inventive crimping tool 101 for turned contacts 102. By actuating lever 119, the toggle joint kinetic 114 is further moved into the stretch position, as a result of which, the thrust collar 139 performs a rotary motion in the clockwise direction. By virtue of the contacting area S between the thrust collar 139 and the crimping stamp 105, the thrust collar 139 will slide along the crimping stamps 105 and will move the crimping stamps 105 radially inwardly toward the contact 102 in opening 107. For the opening of thrust collar 139 in order to receive the stamp holder 121 and the crimping stamp 105, it has an opening whose geometry reminds us of the borehole of a hydrodynamic sliding bearing, where a circular borehole is widened with two or more arc-like areas in which a lubricating wedge can be formed. Such sliding bearings are known in the trade as "lemon chrome play clearance." The contact area S in the thrust collar 139 can be made in the form of a curve with a constant slope or as a curve with a specially adjusted slope to optimize any manual and pressing forces. The crimping stamps 105 are positioned in the stamp holder 141 for the radial movement. Compression springs 142 displace the crimping stamps 105 radially outwardly after the crimping procedure along curve S again back into the starting position.

In order to process the various cross-sections of the turned contacts 102 or conductor cross-sections in a crimping die assembly 104, a force-distance adjustment arrangement is integrated into the basic sheet metal piece 106 in the form of a cascade spring 129, which facilitates a diversion of the rear toggle lever pivot in the direction of the arrow (see FIGS. 6 and 7).

Over the area H on basic sheet metal 106 in each case, the cylindrical pin 130 is used to drive the second spring 131 of the cascade spring 129. Spring 131 is in the same plane as the thrust strut 118 that is located between the two basic sheet metal pieces 106*c* and 106*d*, and—just like thrust strut 118—has a thickness that is almost identical to the interval between the basic sheet metal pieces 106*c* and 106*d*. By means of the advantageous spring action resulting from the cooperation of springs 131, 132, an increased force and an increased distance for the force-distance adjustment device is achieved that is to be provided for the crimping tool. Here, cascade spring arrangement 129 takes care of the required residual stroke of the crimping swage 104 in the form of an elastic deformation action when crimping die assembly 104, during the crimping of a turned contact 102, has already been put upon the stop 124, although a distance must still have to be covered so that the stop 124 will release the opening of the crimping die assembly 104. Crimping tool 101 is thus automatically set for the cross-section of the turned contacts 102 that is to be crimping and the conductor cross-section. This makes it possible with only one crimping die assembly 104 to crimp conductor cross-sections of 0.08 $mm^2$ to 6.0 $mm^2$ step by step. Crimping tool 101 can be closed and opened automatically by skipping over the block 124.

The integration of spring 132 as a parallel-arranged leaf spring into the basic sheet metal pieces 106 facilitates a compact structure of the crimping tool 101 with simultaneous precise adjustment to the needed force-distance adjustment. Compared to other designs, they thus need less structural space with the same output. Spring 132 is made in each case in the basic sheet metal piece 106 by a slot 137 contained in the basic sheet metal piece 106*c*, 106*d*, which cut essentially runs parallel to the other contour of the basic sheet metal piece. To reduce the mechanical tension, the terminal point 138 of the slot 137 is made in a rounded configuration. Along its contour line, slot 137 runs around the pivot pin 115 so that the pivot pin 115 in each case will be in the area of the basic sheet metal piece 106*c*, 106*d* in spring 132 and otherwise in the thrust strut 118 and will emerge on the top of the handle 127 in each case out of basic sheet metal piece 106. Spring 132 thus essentially in each case has a geometric configuration in the form of an arc-shaped or circular arc-shaped leaf spring. To make a worthwhile spring travel distance, cut 137 is made accordingly long and wide. Spring 132 thus is outside handle 127.

To prevent the lifting of area H from cylinder pin 130 and basic sheet metal piece 106 under load, basic sheet metal 106, in each case in area M, has a cross-section with a high degree of stiffness. That prevents a deformation of basic sheet metal pieces 106 due to load and provides for a constantly reproducible force-distance adjustment.

Figure 8:
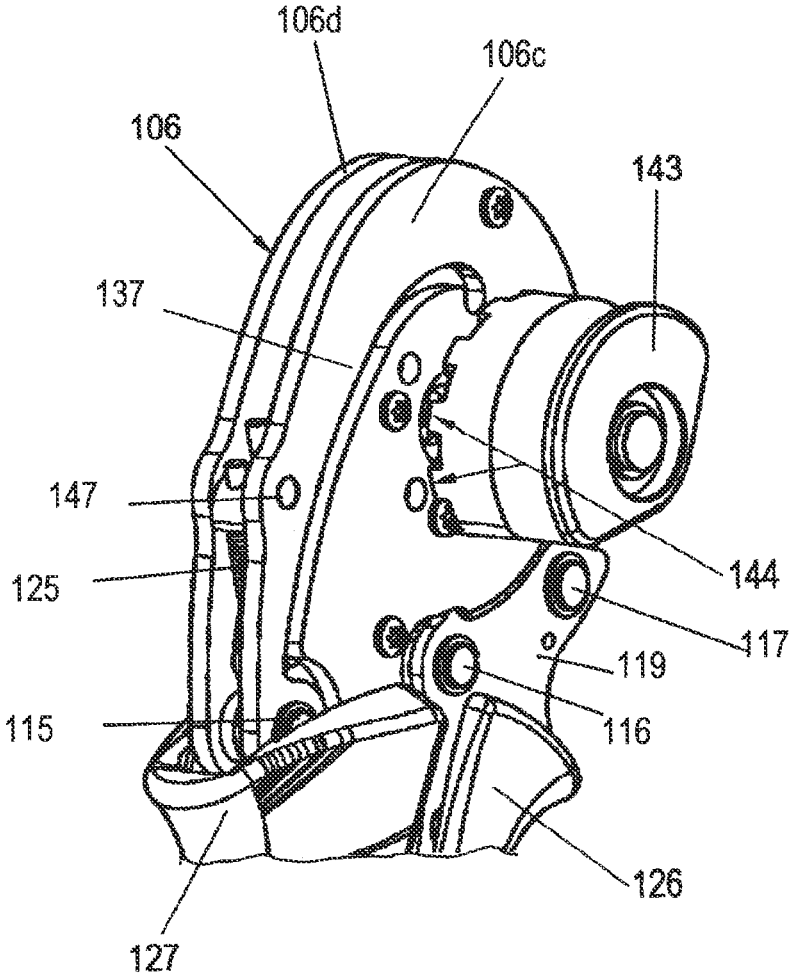
FIG. 8 is a detailed right hand perspective view of the apparatus provided with a contact locator device.

FIG. 8 shows an inventive crimping tool 101 with a tubular contact locator device 143 for turned contacts 102. Locator device 143 is set for the contact type that is to be made and via the tooth gearing arrangement 144 rests in the adjusted position. Contact 102 is inserted into the opened crimping swage 104 and is retained in the crimping position by locator 143. In this way, one can procedurally safely handle and crimp at the designated spot on contact 102. By closing handles 126, 127 of tool 101, contact 102 is crimped upon conductor 103.

FIG. 9 shows a conductor 103 on whose insulated end there was pressed a turned contact 102. In the example illustrated, the turned contact 102 is pressed with a four-point crimp.

While in accordance with the provisions of the Patent Statutes the preferred forms and embodiments of the invention have been illustrated and described, it will be apparent to those skilled in the art that changes may be made without deviating from the invention described above.

What is claimed is:

1. A crimping tool (101) for crimping a tubular portion of a turned electrical contact (102) concentrically about a bare end of an electrical conductor (103), comprising:

(a) a tool body (106) Including a pair of sheet metal components (106*c*, 106*d*), and bolt means (112) rigidly connecting together said sheet metal components in parallel spaced relation, said tool body having a main portion (106*a*), and a lever portion integral and coplanar with, and extending, outwardly from, said tool body main portion, thereby to define a first lever (106*b*);

(b) a second lever (119);

(c) a cylindrical crimping die arrangement (104) mounted in an opening contained in said tool body main portion, said crimping die arrangement including:

(1) an annular crimping stamp holder (104) concentrically arranged in said opening and rigidly secured to said tool body main portion, said crimping stamp holder containing a plurality of radial through bores;

(2) a plurality of crimping stamp members (105) mounted for reciprocatory movement in said radial through bores, respectively, for linear displacement between crimping and released positions;

(3) a plurality of stamp springs (142) biasing said stamp members radially outwardly in said through bores toward said released positions, respectively;

(4) an annular thrust collar (139) mounted concentrically about said stamp holder for angular displacement between crimping and released positions relative to said stamp holder, said thrust collar having internal cam surfaces for displacing said stamp members radially inwardly toward said crimping positions when said thrust collar is in said crimping positions, said stamp members being biased outwardly toward said released positions when said thrust collar is in said released positions;

(d) a toggle link arrangement (114) connecting said second lever both with said tool body main portion and with said thrust collar, said toggle link arrangement including:

(1) first connecting means pivotally connecting said second lever with said tool body main portion for pivotal displacement between closed and open positions relative to said tool body lever portion; and (2) second connecting means (117) connecting said second lever with said thrust collar such that said thrust collar is in said released and crimping positions when said second lever is in said open and closed positions, respectively; and (e) force-distance adjustment means including a cascade spring arrangement (129) for adjusting the angular displacement of said thrust collar relative to said die arrangement when said second lever is pivoted beyond said closed position toward a maximum exertion position, said cascade spring arrangement including:

(1) a deformable resilient first spring (132) integral with said tool body main portion, said first spring being defined by a pair of corresponding slots (137) contained in said sheet metal components main portion, each of said slots extending from a location adjacent a connection between said first lever and said main body portion forwardly of said main body portion, whereby said first spring comprises a leaf-type spring having a free rear end; and (2) a leaf-type second spring (131) carried by said first lever;

(3) said first connecting means including a thrust strut (118) pivotally connected by pivot pins (115, 116) between said first spring free end and said second lever.

2. A crimping tool as defined in claim 1, wherein each of said slots extends generally collinearly relative to said tool body first lever; and further wherein said second spring comprises a generally longitudinally extending leaf spring having a rear end connected with said first lever, and a front end arranged for cooperation with said first spring rear end.

3. A crimping tool as defined in claim 2, wherein said deformable resilient first spring has a generally arcuate configuration.

4. A crimping tool as defined in claim 2, wherein said deformable resilient first spring has a general circular configuration.

5. A crimping tool as defined in claim 1, wherein said thrust collar has an internal surface provided with a plurality of cam surfaces (S) arranged for cooperation with the ends of said stamp members, respectively.

6. A crimping tool as defined in claim 5, wherein each of said cam surfaces has a constant slope.

7. A crimping tool as defined in claim 5, wherein each of said cam surfaces has a custom-designed slope affording optimum manual and pressing forces.

8. A crimping tool as defined in claim 5, wherein said crimping die means accommodates contacts for electrical conductors having cross-section ranging from 0.08 $mm^2$ to 6.0 $mm^2$.

9. A crimping tool as defined in claim 1, and further including generally tubular contact locator means (143) for supporting a contact relative to said die arrangement.

10. A crimping tool as defined in claim 9, and further including tooth and slot means (144) for connecting said contact locator means with said tool body.

11. A crimping tool as defined in claim 1, wherein said second toggle link connecting means comprises an eccentric pivot pin (117) for adjusting the angular displacement of said thrust collar relative to said die arrangement.

12. A crimping tool as defined in claim 11, and further including an adjusting disk (121) and a flathead screw (122) for locking said eccentric pivot pin against displacement relative to said second lever.

13. A crimping tool as defined in claim 1, and further including stop means (124) cooperating with said thrust strut when said levers are in said closed position to prevent premature opening of said levers.

14. A crimping tool as defined in claim 1, and further including a pair of handle members (126, 127) mounted on said second lever and on said tool body lever portion, respectively.

15. A crimping tool as defined in claim 1, and further including:

(f) return spring means (125) biasing said levers toward said open position; and (g) stop means (125) for retaining said levers in said closed position.

* * * * *